US005309654A

United States Patent [19]

Mathis

[11] Patent Number: 5,309,654

[45] Date of Patent: May 10, 1994

[54] SNOW AND ICE BROOM

[76] Inventor: Johnny L. Mathis, 604 Pioneer Rd., Papillion, Nebr. 68128

[21] Appl. No.: 45,883

[22] Filed: Apr. 15, 1993

[51] Int. Cl.[5] ..... E01H 5/12

[52] U.S. Cl. ..... 37/284; 37/270; 37/285; 15/143.1; 15/111; 294/51

[58] Field of Search ..... 15/105, 111, 143.1; 37/232, 241, 265, 266, 270, 284, 285; 294/51, 54.5, 57

[56] References Cited

U.S. PATENT DOCUMENTS

| | | | |
|---|---|---|---|
| 950,012 | 2/1910 | Bender | 15/111 |
| 1,922,998 | 8/1933 | Williams | 37/241 |
| 2,163,979 | 6/1939 | Judson | 15/111 |
| 2,290,178 | 7/1942 | Hayford | 15/111 |
| 2,867,827 | 1/1959 | Gantz | 37/244 |
| 3,307,212 | 3/1967 | MacInnes | 15/111 |
| 4,153,287 | 5/1979 | Towsend | 37/232 |
| 5,133,101 | 7/1992 | Hauser et al. | 294/57 |

FOREIGN PATENT DOCUMENTS

| | | | |
|---|---|---|---|
| 241590 | 8/1946 | Switzerland | 294/57 |
| 561688 | 5/1944 | United Kingdom | 294/57 |
| 2150015 | 6/1985 | United Kingdom | 15/111 |

*Primary Examiner*—Stephen F. Gerrity
*Assistant Examiner*—Mark Spisich
*Attorney, Agent, or Firm*—S. Michael Bender

[57] ABSTRACT

A new and improved combined snow pusher, ice chopper, and broom apparatus for clearing a surface includes a handle which is supported by a support and which projects upward from the top of the support at a first acute angle with respect to the support. Bristles are supported by the support, and the bristles project downward from the bottom of the support by a first distance. A panel element is supported by the support at the front of the support. The panel element is connected directly to the support, and the bottom end of the panel element projects downward past the bottom of the support by a second distance. The second distance is less than the first distance, whereby the portion of the panel element which extends below the support element protects the interface between the bristles and the support, whereby the panel element does not contact the surface to be cleared. The bottom end of the panel element includes a sharp lower edge. In a first mode of operation, the bristles are placed on the surface to be cleared, the panel element is used to push material out of a path on the surface, and the bristles are used to sweep material out of the path on the surface. In a second mode of operation, the apparatus is rotated 180 degrees, and the sharp edge of the panel element is placed on the surface to be cleared. In this mode, the apparatus can be used for chopping ice.

4 Claims, 5 Drawing Sheets

SNOW AND ICE BROOM

BACKGROUND OF THE INVENTION

1. Field of the Invention

The present invention relates generally to implements for clearing snow and debris from sidewalks, driveways, and the like, and more particularly, to an implement having both snow plow and broom functions.

2. Description of the Prior Art

Shop brooms are well known and generally include a long straight handle portion connected to a relatively long and wide broom portion which provides excellent sweeping capabilities. However, such shop brooms are not well suited for clearing sidewalks and driveways of substantial snow accumulations. In this respect, it would be desirable if a device were provided which is well suited for clearing substantial snow accumulations and which also provides excellent sweeping capabilities.

Conventional snow shovels provide blades which closely contact the surface of the sidewalks, driveway, and the like. As a result, the leading edge of a blade often bumps up against uneven surfaces, such as uneven blocks of sidewalk concrete, and transmits a jolt to the user of the snow shovel. In this respect, it would be desirable if a snow shovel were provided which rode over uneven surfaces in a sidewalk, or the like, thereby preventing the user from being jolted by those uneven surfaces.

Moreover, the close contact of conventional snow shovels with the surface being cleared often does damage to the surface that is being cleared. Snow shovels often have metal blades, and the metal blades often do damage to the surface being cleared. In this respect, it would be desirable if a snow clearing apparatus were provided that avoided damage to the surface being cleared due to contact by a metal snow shovel blade.

Not only does contact between a metal blade and the surface being cleared cause damage to the surface, but the contact may also cause damage to the blade. Concrete surfaces are very abrasive and may rapidly wear out the leading edges of metal or plastic blades. In this respect, it would be desirable if an implement for clearing snow from surfaces were provided which prevented the surface from damaging the snow clearing blade.

Some snow shovels are designed to move snow from walkways and the like by sliding under a quantity of snow, and by the user lifting the shovel and the snow and throwing the snow away from the walkway. Such repetitive lifting and throwing of snow can be very laborious. Moreover, such lifting and throwing puts considerable stress on back muscles, leading to unpleasant back aches. In this respect, it would be desirable if a snow moving implement were provided that avoided lifting and throwing of snow.

When snow accumulates, patches of ice are often present. To remove ice, a chopping action is often required from a sharp metal implement. In this respect, it would be desirable if a snow removing implement were provided with a sharp portion for chopping ice. Also with respect to ice, it would be desirable if the implement that is used for clearing snow could also have provisions for dispensing a material that is designed to reduce the slipperiness of ice. Such a material could be an abrasive such as sand or a ice melting chemical such as salt.

In many persons minds, clearing snow from walkways and clearing debris from indoor floor surfaces are two distinct operations which require two separate and distinct implements. Moreover, the snow clearing implement usually gets less service because of its seasonal nature. Thus, for most of the year, the snow clearing implement must be kept in storage. To size money and storage space, it would be desirable if a single implement were provided that could be used all year round for its sweeping characteristics and could be used for clearing snow when the occasion arose.

Most conventional snow clearing implements and most conventional broom implements have long, straight handles. Such handles present a relatively sharp handle point to the body of the user if the user wants to get directly behind the handle and push it. In this respect, it would be desirable if a handle were provided for a snow pushing implement which avoided presenting a relatively sharp handle point to the body of the user when the user pushes the implement.

A number of snow clearing implements are known in the prior art as represented by the following U.S. Pat. Nos. 3,773,375 of Nehls; 3,804,451 of Burke; 4,597,204 of Heiden; 4,991,324 of Fine et al; and Des. 302,059 of Sanders. Nehls discloses a snow removal device designed for removing snow from high, elevated roofs. Burke discloses a snow broom in which an array of metal tines can be selectively maintained separately as broom bristles or maintained in close association as a shovel blade. Heiden discloses a snow pusher which has an adjustable straight handle, a resilient blade, and a snow diverting member. Fine et al discloses a snow removal device having two handles and a blade whose width is adjustable.

In particular, with respect to the Sanders patent, Sanders discloses a snow broom in which a snow pushing panel is mounted on the top of the bristle support. The bristles are completely exposed to the snow, and no ice chopping capabilities are possible. It is noted that snow and moisture can easily push into the region of the bristle support where the bristles are connected to the bristle support. When this interface region deteriorates, bristles can easily fall out of the bristle support. In this respect, it would be desirable if the bristles of a broom that is converted into a snow pusher have a provision for protecting the interface between the bristles and the bristle support from snow damage.

Thus, while the foregoing body of prior art indicates it to be well known to use snow pushers and brooms, the prior art described above does not teach or suggest a combination snow pusher, ice chopper, and broom apparatus which has the following combination of desirable features: (1) is well suited for clearing substantial snow accumulations and which also provides excellent sweeping capabilities; (2) rides over uneven surfaces in a sidewalk, or the like, thereby preventing the user from being jolted by those uneven surfaces; (3) avoids a user lifting and throwing snow; (4) avoids damage to the surface being cleared due to contact by a metal snow shovel blade; (5) prevents the surface from damaging the snow clearing blade; (6) having a sharp portion for chopping ice; (7) can be used all year round for its sweeping characteristics and can be used for clearing snow when the occasion arose; (8) provides a handle for a snow pushing implement which avoids presenting a relatively sharp handle point to the body of the user when the user pushes the implement; (9) in a push broom converted into a snow broom, has a provision for protecting the interface between the bristles and the bristle support from snow damage; and (10) provides for dispensing a material that is designed to reduce the slipperiness of ice. The foregoing desired characteristics are provided by the unique snow pusher, ice chopper, and broom apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved combined snow pusher, ice chopper, and broom apparatus for clearing a surface. The apparatus includes a support element which includes a front, a back, a top, and a bottom. A handle is supported by the support element, and the handle projects upward from the top of the support element at a first acute angle with respect to the back of the support element. A plurality of bristles are supported by the support element, and the bristles project downward from the bottom of the support element by a first distance. A panel element is supported by the support element at the front of the support element, and the panel element includes a bottom end and a top end. The bottom end of the panel element is connected directly to the support element and projects downward past the bottom of the support element by a second distance. The second distance is less than the first distance, whereby the portion of the panel element which extends below the support element protects the interface between the bristles and the support element, and whereby the panel element does not contact the surface to be cleared. The portion of the panel element which extends below the support element also protects the bristles from being pushed back too far by the snow. The bottom end of the panel element includes a sharp lower edge. A bracing assembly, connected between the panel element and the support element, is used for bracing the panel element against the support element. In a first mode of operation, the bristles are placed on the surface to be cleared, the panel element is used to push material out of a path on the surface, and the bristles are used to sweep material out of the path on the surface. In the first mode of operation, the handle is pushed by a user toward the front of the support element in a direction substantially parallel to the surface. In a second mode of operation, the apparatus is rotated 180 degrees, and the sharp edge of the panel element is placed on the surface to be cleared. In the second mode of operation, the apparatus is moved toward the surface by a user who pushes the handle in a direction at a second acute angle with respect to the surface.

The bracing assembly can include a first bracing element and a second bracing element, wherein a portion of the first bracing element is connected to the panel element, a portion of the first bracing element is connected to a portion of the second bracing element, and a portion of the second bracing element is connected to the support element.

The handle includes an end, and a handle-end assembly can be connected to the handle end. The handle-end assembly may include a base assembly, connected to the handle end, and a gripping portion attached to the base member. The base member is oriented approximately perpendicular to a longitudinal axis of the handle. Preferably, the gripping portion is arch-shaped and includes a first arch end connected to a first end of the base member, and includes a second arch end connected to a second end of the base member. The gripping member may include a rigid core and a resilient outer layer which may be a resilient foam covered by cloth. This arrangement of the handle-end assembly permits a person using the apparatus to push the apparatus with both his hands and the weight of his body directly onto the gripping portion of the handle-end assembly.

In accordance with another aspect of the invention, the snow pusher, ice chopper, and broom apparatus also includes a material dispensing assembly, connected to the handle, for dispensing material onto the surface in front of the panel element. The material dispensing assembly includes a material storage assembly for retaining the material to be dispensed. The material storage assembly includes a front side and a rear side. An adjustable nozzle assembly, located at the front side of the material storage assembly and projecting forward of the panel element is used for dispensing material from the material storage assembly onto the surface. A bracket assembly, connected to the material storage assembly, is used for connecting the material storage assembly to the handle and for securing the material dispensing assembly to the handle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved snow pusher, ice chopper, and broom apparatus which has all of the advantages of the prior art and none of the disadvantages.

It is another object of the present invention to provide a new and improved snow pusher, ice chopper, and broom apparatus which may be easily and efficiently manufactured and marketed.

It is a further object of the present invention to provide a new and improved snow pusher, ice chopper, and broom apparatus which is of durable and reliable construction.

An even further object of the present invention is to provide a new and improved snow pusher, ice chopper, and broom apparatus which is susceptible of a low cost of manufacture with regard to both materials and labor, and which accordingly is then susceptible of low prices of sale to the consuming public, thereby making such snow pusher, ice chopper, and broom apparatus available to the buying public.

Still yet a further object of the present invention is to provide a new and improved snow pusher, ice chopper, and broom apparatus which is well suited for clearing substantial snow accumulations and which also provides excellent sweeping capabilities.

Still another object of the present invention is to provide a new and improved snow pusher, ice chopper, and broom apparatus which rides over uneven surfaces in a sidewalk, or the like, thereby preventing the user from being jolted by those uneven surfaces.

Yet another object of the present invention is to provide a new and improved snow pusher, ice chopper, and broom apparatus that avoids the user having to lift and throw snow.

Even another object of the present invention is to provide a new and improved snow pusher, ice chopper, and broom apparatus that avoids damage to the surface being cleared due to contact by a metal snow shovel blade.

Still a further object of the present invention is to provide a new and improved snow pusher, ice chopper, and broom apparatus which prevents the surface being cleared from damaging the snow clearing blade.

Yet another object of the present invention is to provide a new and improved snow pusher, ice chopper, and broom apparatus with a sharp portion for chopping ice.

Still another object of the present invention is to provide a new and improved snow pusher, ice chopper, and broom apparatus that can be used all year round for its sweeping characteristics and can be used for clearing snow when the occasion arises.

Yet another object of the present invention is to provide a new and improved snow pusher, ice chopper, and broom apparatus which avoids presenting a relatively sharp handle point to the body of the user when the user pushes the implement.

Still another object of the present invention is to provide a new and improved snow pusher, ice chopper, and broom apparatus that protects the interface between the bristles and the bristle support from snow damage.

Yet another object of the present invention is to provide a new and improved snow pusher, ice chopper, and broom apparatus that includes provisions for dispensing a material that is designed to reduce the slipperiness of ice.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 2:
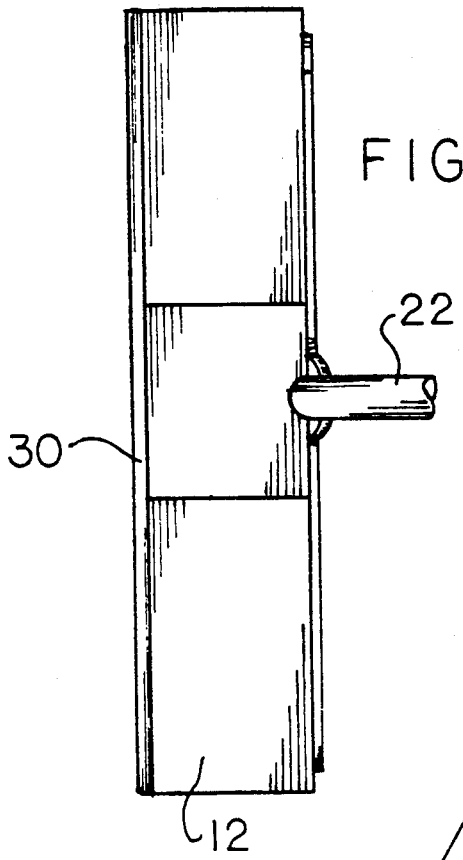
FIG. 2 is a top view of the snow pusher, ice chopper, and broom apparatus of the invention taken along line 2—2 of FIG. 1.

With reference to the drawings, a new and improved snow pusher, ice chopper, and broom apparatus embodying the principles and concepts of the present invention will be described.

Turning initially to FIGS. 1–4, there is shown a first exemplary embodiment of the combined snow pusher, ice chopper, and broom apparatus of the invention generally designated by reference numeral 10. In its preferred form, the combined snow pusher, ice chopper, and broom apparatus 10 of the invention is used for clearing a surface 11 and includes a support element 12 which includes a front 14, a back 16, a top 18, and a bottom 20. A handle 22, supported by the support element 12, projects upward from the top 18 of the support element 12 at a first acute angle 24 with respect to the top 18 of the support element 12. A plurality of bristles 26, supported by the support element 12, project downward from the bottom 20 of the support element 12 by a first distance 28.

A panel element 30 is supported by the support element 12 at the front 14 of the support element 12. The panel element 30 includes a bottom end 32 and a top end 34. The bottom end 32 is connected directly to the support element 12 (by screws or rivets, not shown) and projects downward past the bottom 20 of the support element 12 by a second distance 36. The second distance 36 is less than the first distance 28 whereby the panel element 30 protects the interface between the bristles 26 and the support element 12, and whereby the panel element 30 does not contact the surface 11 to be cleared. The bottom end 32 includes a sharp lower edge 42.

Figure 4:
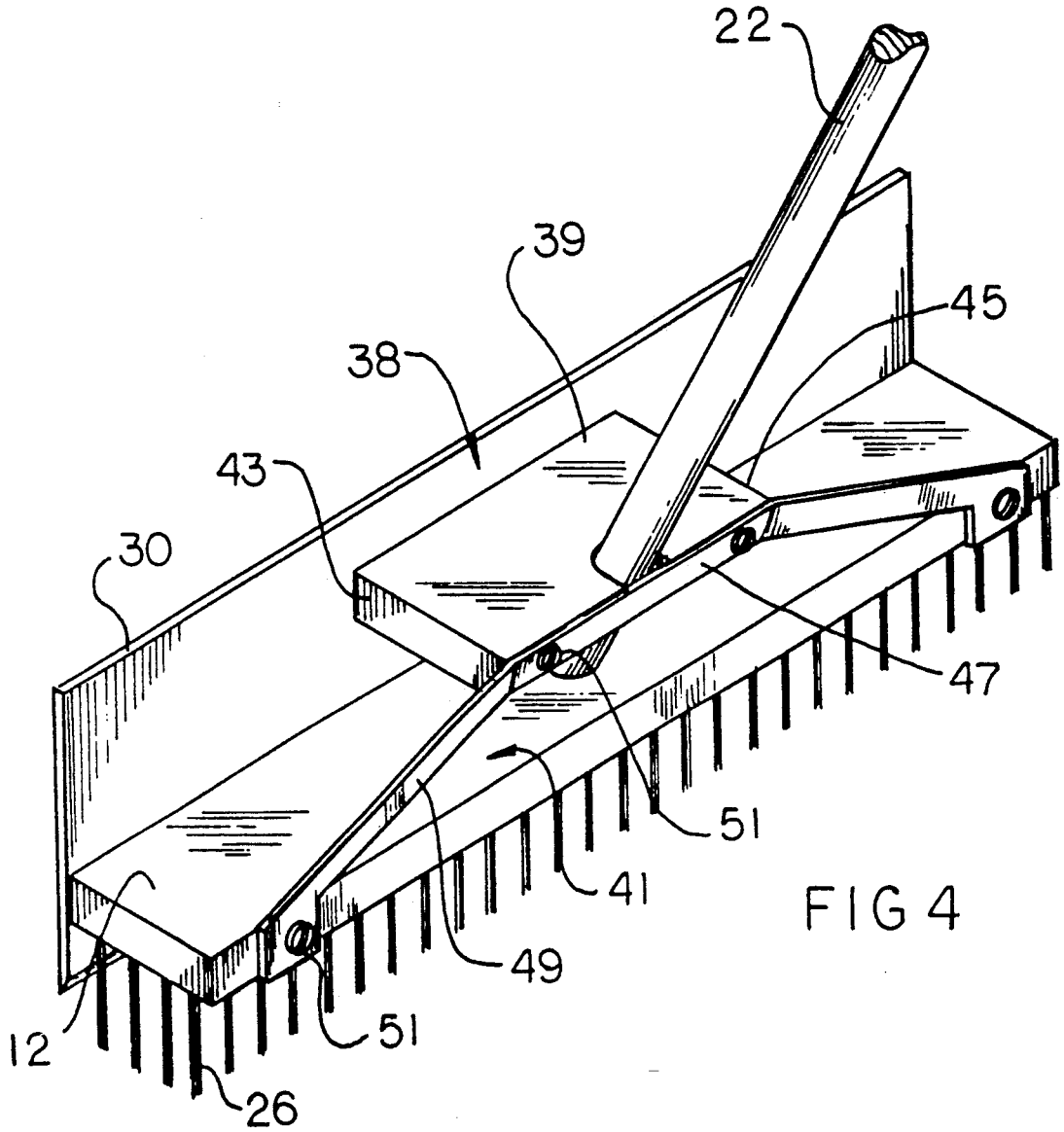
FIG. 4 is a rear, partial perspective view of the embodiment of the invention shown in FIG. 1.

As best shown in FIG. 4, a bracing assembly 38, connected between the panel element 30 and the support element 12, is used for bracing the panel element 30 against the support element 12. More specifically, the bracing assembly 38 includes a first bracing element 39 (e.g. a wooden block 39) and a second bracing element 41 (e.g. a C-shaped metal bar 41). A front portion 43 of the first bracing element 39 is connected to the panel element 30 (by fasteners, such as screws, not shown) in a perpendicular manner. A rear portion 45 of the first bracing element 39 is connected to a first portion 47 of the second bracing element 41 by screws 51 in a perpendicular manner, and a second portion 49 of the second bracing element 41 is connected to the support element 12 by screws 51. In this way, the panel element 30 is braced against the support element 12 through the first bracing element 39 and the second bracing element 41 and the respective screws. The wooden block 39 has a notch through which the handle 22 passes. The handle 22 is sandwiched between the first bracing element 39 and the second bracing element 41, and, as such, provides additional support for the panel element 30.

Figure 1:
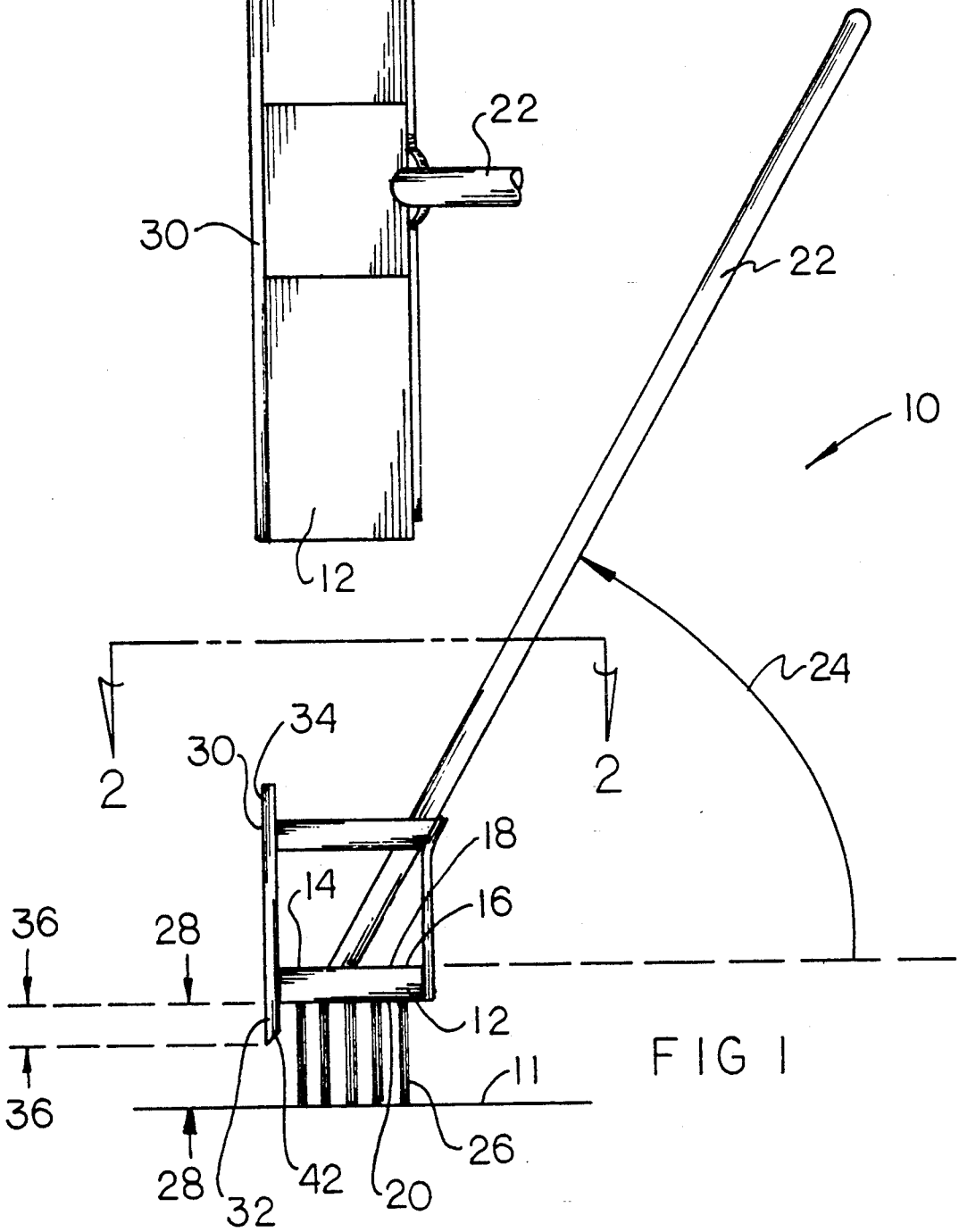
FIG. 1 is a side view showing a first preferred embodiment of the snow pusher, ice chopper, and broom apparatus in a snow clearing mode with the bristles on the surface.

In a first mode of operation, as shown in FIG. 1, the panel element 30 is used to push material (not shown) out of a path on the surface 11, and the bristles 26 are used to sweep material out of the path on the surface 11. This first mode of operation occurs when the bristles 26 are placed on the surface 11, and the handle 22 is pushed by a user toward the front 14 of the support element 12 in a direction substantially parallel to the surface 11. As shown in FIG. 1, the panel element 30 is a substantially flat metal plate.

Figure 3:
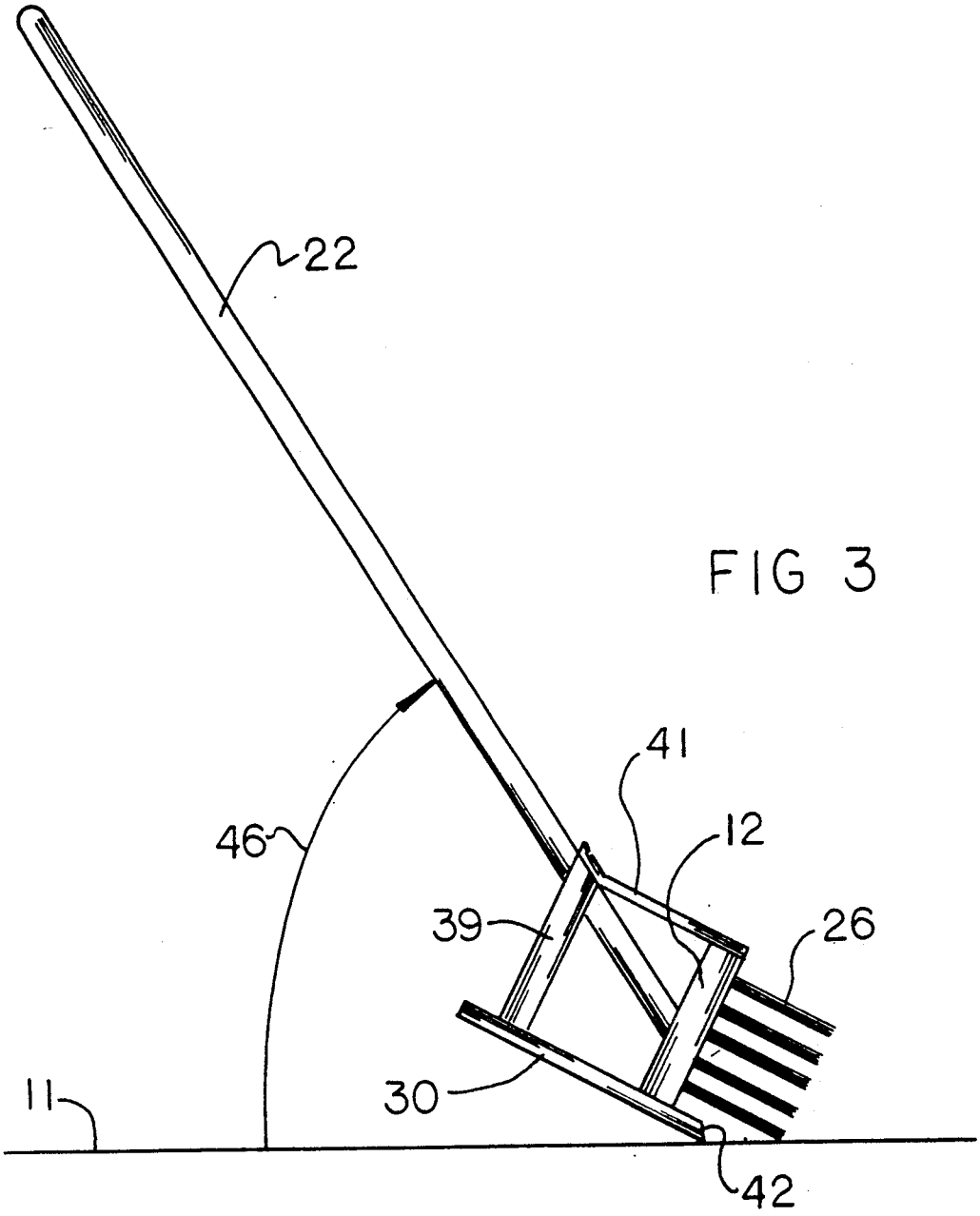
FIG. 3 is a side view showing of the embodiment of the invention shown in FIG. 1 in an ice chopping mode with the sharp edge of the panel element on the surface.

In a second mode of operation, as shown in FIG. 3, the apparatus 10 is rotated 180 degrees, and the sharp lower edge 42 of the panel element 30 is moved toward the surface 11 by a user who pushes the handle 22 in a direction at a second acute angle 46 with respect to the surface 11. In this second mode of operation, the sharp lower edge 42 of the panel element 30 can be used for chopping ice (not shown).

Figure 7:
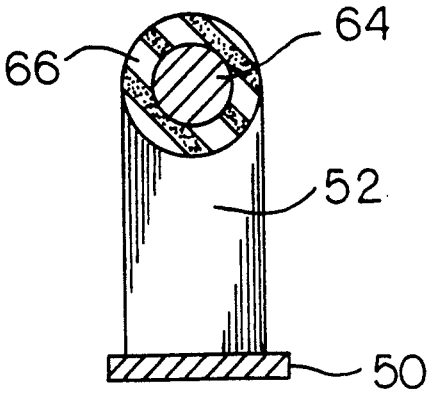
FIG. 7 is a cross-sectional view of the gripping portion of the handle-end assembly taken along the line 7—7 of FIG. 6.
Figure 6:
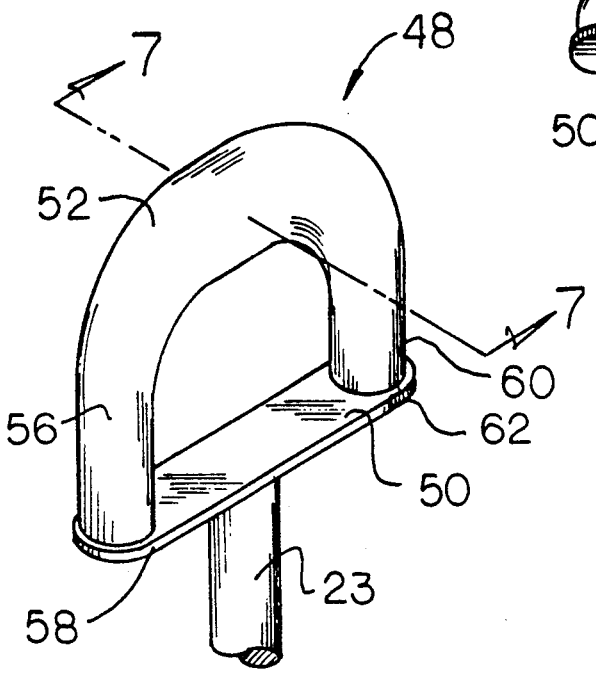
FIG. 6 an enlarged perspective view of the handle-end assembly shown in FIG. 5.
Figure 5:
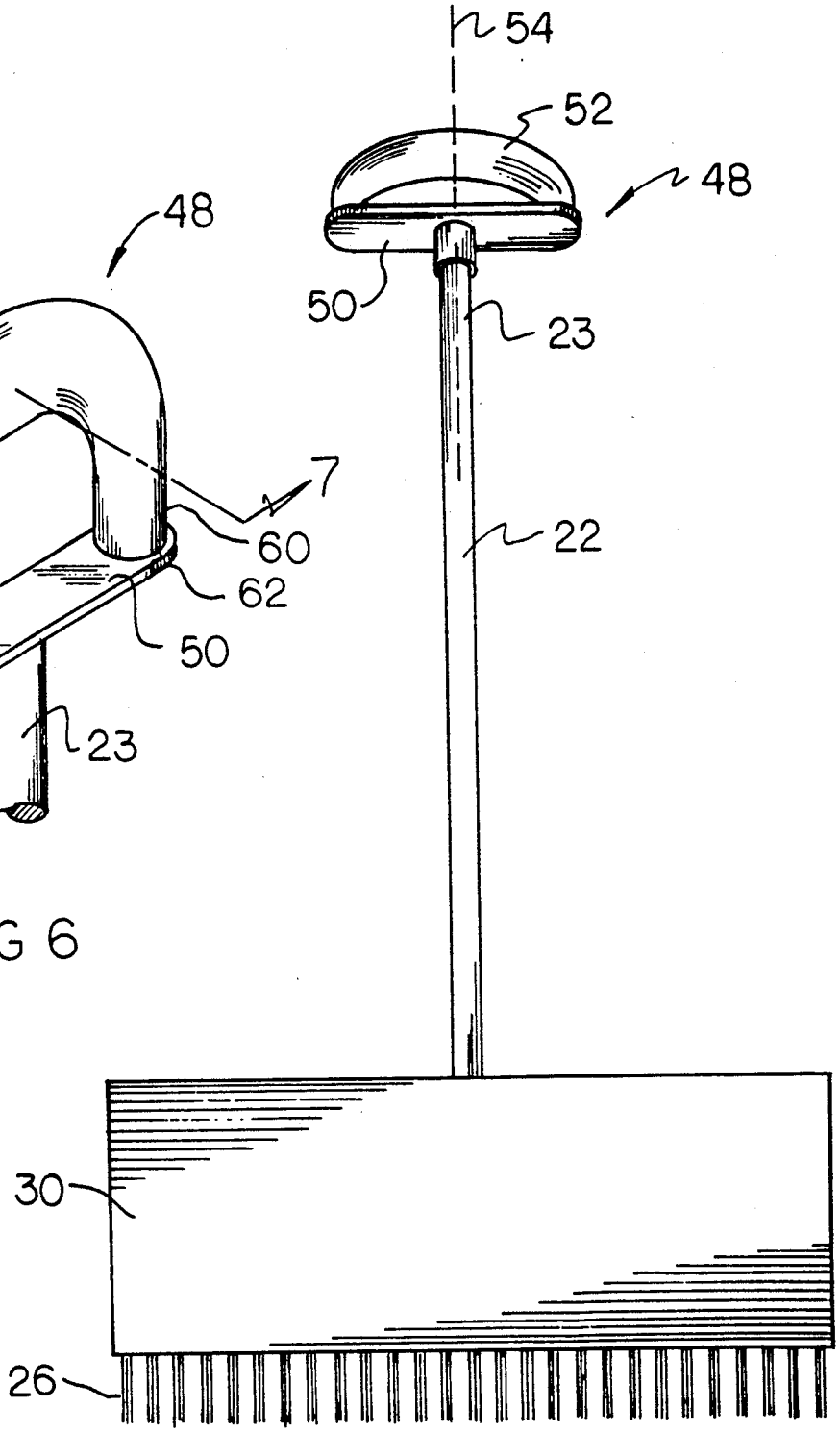
FIG. 5 is a front view a second preferred embodiment of the invention which includes a handle-end assembly.

Turning to FIGS. 5-7, a second embodiment of the invention is shown. Reference numerals are shown that correspond to like reference numerals that designate like elements shown in the other figures. In addition, the handle 22 includes an end 23 and further includes a handle-end assembly 48, connected to the handle end 23. The handle-end assembly 48 includes a base assembly 50, and the base assembly 50 is connected to the handle end 23. A gripping portion 52 is attached to the base member 50. The base member 50 is oriented approximately perpendicular to a longitudinal axis 54 of the handle 22.

The gripping portion 52 is arch-shaped and includes a first arch end 56 connected to a first end 58 of the base member 50 and includes a second arch end 60 connected to a second end 62 of the base member 50. As shown in FIG. 7, the gripping member 52 includes a rigid core 64 and a resilient outer layer 66. The resilient outer layer 66 includes a resilient foam.

Figure 9:
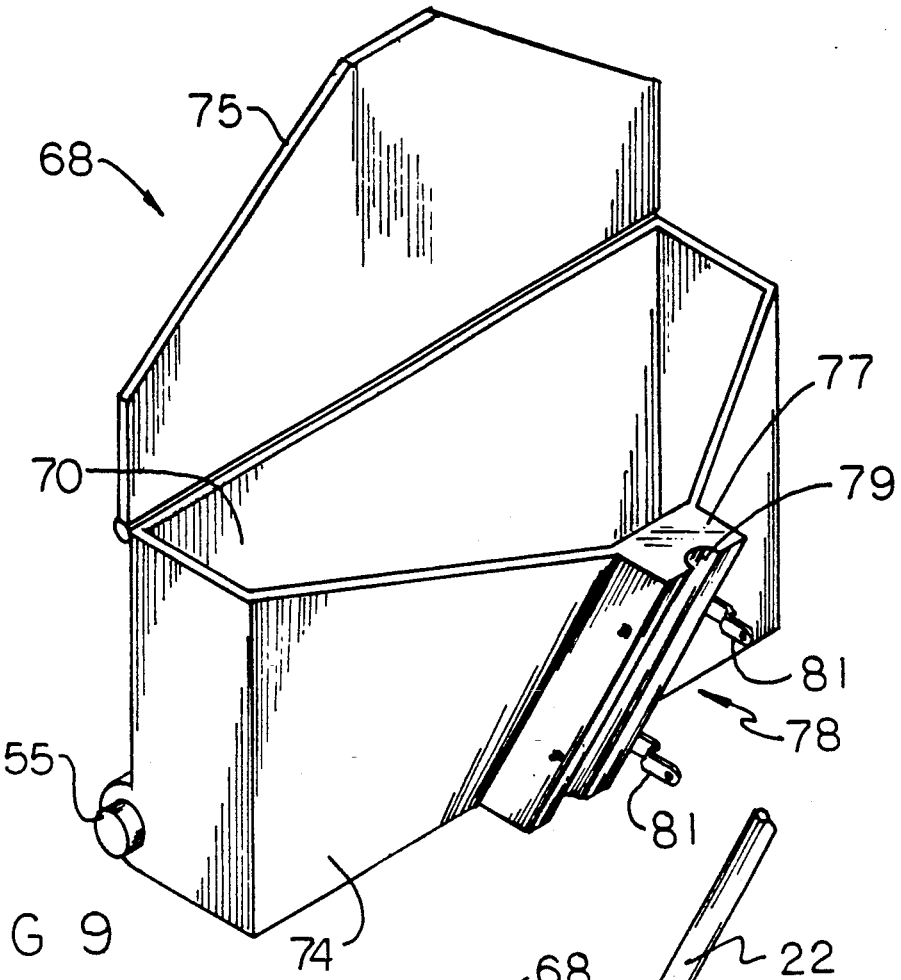
FIG. 9 is a rear perspective view of the material dispensing assembly shown in FIG. 8 removed from the handle and support element.
Figure 8:
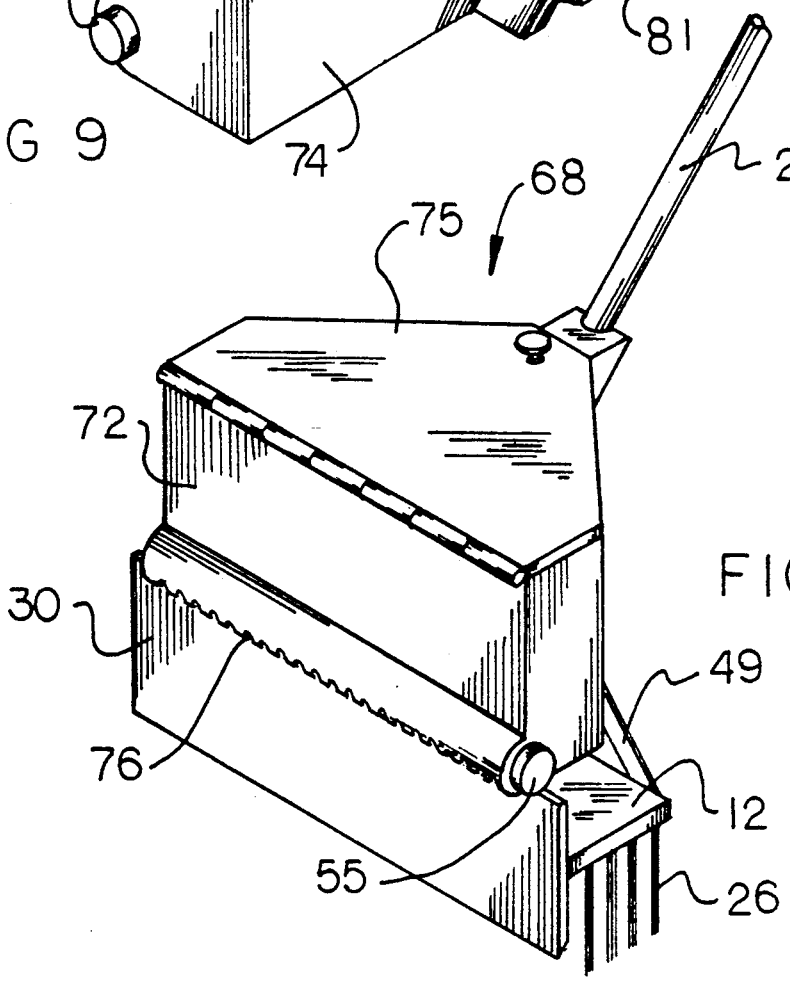
FIG. 8 is a front perspective view of a third preferred embodiment of the invention which includes a material dispensing assembly.

Turning to FIGS. 8-9, a third embodiment of the invention is shown. Reference numerals are shown that correspond to like reference numerals that designate like elements shown in the other figures. In addition, a material dispensing assembly 68 is connected to the handle 22. The material dispensing assembly 68 is used for dispensing material onto the surface 11 in front of the panel element 30. The material that is dispensed may include an abrasive material, such as sand; or the dispensed material can be an ice-melting material such as salt.

More specifically, the material dispensing assembly 68 includes a material storage assembly 70 for retaining the material to be dispensed. The material storage assembly 70 includes a front side 72, a rear side 74, and a hinged cover 75. An adjustable nozzle assembly 76 is located at the front side 72 of the material storage assembly 70 and projects forward of the panel element 30, for dispensing material from the material storage assembly 70 onto the surface 11. The nozzle assembly 76 includes a conventional adjustable valve structure (not shown) and includes a control knob 55 for controlling the adjustable valve.

A bracket assembly 78 is connected to the material storage assembly 70 and is used for connecting the material storage assembly 70 to the handle 22, for securing the material dispensing assembly 68 to the handle 22. More specifically, the bracket assembly 78 includes a block portion 77 which includes a semi-circular groove 79 that is complementary to the circular shape of the handle 22. Straps 81 and screws (not shown) are used to secure the block portion 77 to the handle 22. The bottom of the material storage assembly 70 is dimensioned so that it rests upon the top of the first bracing element 39.

The bracing assembly 38 that is disclosed above includes a first bracing element 39 and a second bracing element 41 that are connected to each other. Alternatively, the bracing assembly 38 could include a first bracing element that is connected to the handle. An optional second bracing element could also be connected to the handle.

As described above, the panel element 30 is disclosed as being a flat metal plate. The metal can be aluminum so as to free from rust. The panel element 30 can also be made of inexpensive plastic materials, wood, or fiberglass. Moreover, the panel element 30 need not be flat. Instead, the panel element 30 can be curved in the manner of a snow plow blade or snow pusher blade often used on manual, snow-pushing implements. That is the blade can be cylindrically curved around an axis which is parallel to the surface being cleared.

A conventional shop broom can be used with respect to providing the handle, the support element, and the bristles. In this respect, the snow pusher, ice chopper, and broom apparatus of the invention can be used as all year round as a conventional broom when not used for pushing snow or chopping ice.

It is apparent from the above that the present invention accomplishes all of the objects set forth by providing a new and improved snow pusher, ice chopper, and broom apparatus that is low in cost, relatively simple in design and operation, and which may advantageously be used for providing a snow clearing and sweeping action. More specifically, with the invention, a snow pusher, ice chopper, and broom apparatus is provided which is well suited for clearing substantial snow accumulations and which also provides excellent sweeping capabilities. With the invention, a snow shovel is provided which rides over uneven surfaces in a sidewalk, or the like, thereby preventing the user from being jolted by those uneven surfaces. With the invention, a snow moving implement is provided that avoids the user lifting and throwing snow. With the invention, a snow clearing apparatus is provided that avoids damage to the surface being cleared due to contact by a metal snow shovel blade. Also, with the invention, when snow is being pushed, because the bristles instead of a metal blade contact the surface being cleared the bristles ride over uneven surfaces instead of bumping up against them. Also, because the bristles contact the surface being cleared, the snow clearing operation is a quiet operation and does not generate constant and irritating noises caused by metal scraping against concrete. This fact permits the snow pusher, ice chopper, and broom apparatus of the invention to be used very early in the morning or late at night without disturbing neighbors.

Also, with the invention, an implement for clearing snow from surfaces is provided which prevents the surface from damaging the snow clearing blade. With the invention, a snow removing implement is provided which includes a sharp portion for chopping ice. With the invention, a single implement is provided that can be used all year round for it sweeping characteristics and can be used for clearing snow when the occasion arises. With the invention, a handle is provided for a snow pushing implement which avoids presenting a relatively sharp handle point to the body of the user when the user pushes the implement. With the invention, for a broom that is converted into a snow pusher, a provision is made for protecting the interface between the bristles and the bristle support from snow damage. With the invention, provisions are made for dispensing a material that is designed to reduce the slipperiness of ice. Such a material could be an abrasive such as sand or a ice melting chemical such as salt.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved snow pusher, ice chopper, and broom apparatus for clearing a surface, comprising:

a support element which includes a front, a back, a top, and a bottom, a handle, supported by said support element, which projects upward from said top of said support element at a first acute angle with respect to said top of said support element, a plurality of bristles, supported by said support element, which project downward from said bottom of said support element by a first distance, a substantially flat plate panel element, supported by said support element at the front of said support element, said panel element including a bottom end and a top end, wherein said bottom end is connected directly to said support element and projects downward past said bottom of said support element by a second distance, wherein said second distance is less than said first distance, wherein said bottom end includes a sharp lower edge, and bracing assembly means, connected between said panel element and said support element, for bracing said panel element against said support element, said bracing assembly means including a first bracing element and a second bracing element, a portion of said first bracing element being connected to said panel element substantially perpendicular to said panel element, a portion of said first bracing element being connected to a portion of said second bracing element substantially perpendicular to said second bracing element, and a portion of said second bracing element being connected to said support element, wherein, in a first mode of operation, said panel element is used to push material out of a path on the surface, and said bristles are used to sweep material out of the path on the surface, when said bristles are placed on the surface, and said handle is pushed by a user toward said front of said support element in a direction substantially parallel to the surface, and wherein, in a second mode of operation, said sharp edge of said panel element is moved toward the surface by a user who pushes said handle in a direction at a second acute angle with respect to the surface.

2. The apparatus described in claim 1 wherein said handle includes an end and further includes a handle-end assembly connected to said handle end, which includes a base assembly, connected to said handle end, and a gripping portion attached to said base assembly, wherein said base assembly is oriented approximately perpendicular to a longitudinal axis of said handle, wherein said gripping portion is arch-shaped and includes a first arch end connected to a first end of said base assembly and includes a second arch end connected to a second end of said base assembly.

3. The apparatus described in claim 2 wherein said gripping portion includes a rigid core and a resilient outer layer.

4. The apparatus described in claim 3 wherein said resilient outer layer includes a resilient foam.

* * * * *